US006482018B1

(12) United States Patent
Stekelenburg

(10) Patent No.: US 6,482,018 B1
(45) Date of Patent: Nov. 19, 2002

(54) HOLDING UNIT FOR ELECTRICAL DEVICES

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 09/879,063

(22) Filed: Jun. 13, 2001

(51) Int. Cl.[7] ..... H01R 25/00

(52) U.S. Cl. ..... 439/111; 439/120; 439/209; 248/49; 248/300

(58) Field of Search ..... 439/110, 121, 439/94, 209, 120, 111; 248/49, 65, 225.11, 300

(56) References Cited

U.S. PATENT DOCUMENTS 1,955,168 A * 4/1934 Beersman
2,072,702 A * 3/1937 Beersman
2,680,233 A * 6/1954 McFarlin
2,708,264 A * 5/1955 Boyd
4,881,907 A * 11/1989 Bergman et al.
5,595,494 A * 1/1997 Wiebe
5,788,517 A * 8/1998 Elmouchi
6,253,898 B1 * 7/2001 O'Brien

* cited by examiner

*Primary Examiner*—Korie Chan
(74) *Attorney, Agent, or Firm*—Troxell Law Office PLLC

(57) ABSTRACT

A holding unit for holding electrical devices, and a mounting system utilizing such holding units are disclosed. The holding unit has an elongated body with first and second spaced apart, parallel walls, a central wall having opposite sides and extending between, and interconnecting the first and second spaced apart walls so as to form a generally C-shaped cross-sectional configuration with a mounting space between the first and second walls, which are resiliently movable. The holding unit also includes at least one recess formed in each of the opposite sides of the central wall such that the recesses extend along a length of the elongated body and are configured to accept electrical wires. At least one mounting projection extends from each of the first and second walls into the mounting space and are configured to grip an electrical device such that the electrical device is releasably held in the mounting unit.

6 Claims, 3 Drawing Sheets

HOLDING UNIT FOR ELECTRICAL DEVICES

FIELD OF THE INVENTION

This invention relates to a holding unit for holding electrical devices, electrical wires, cable wires, phone wires, etc. The holding unit according to the present invention can also have interconnected power receivers/supply units attached to it.

BACKGROUND OF THE INVENTION

During our regular life, electrical products provide us with various items, for example, televisions, radios, telephones, and computers. These devices usually require protecting or controlling equipment like timers, surge protectors, ground fault circuit interrupters . . . etc. However, lots of these protectors have overlapping functions, and some electronics might not even have protectors. Because of this, the environment of the electrical devices looks messy and unorganized.

On the other hand, many electrical products are serializable or contain serializable parts to protect the product or have other functions. Therefore, we can see the future of serializable products being accepted by customers.

In order to improve aesthetics and utility, the following products may be used with this holding unit: surge protectors, ground fault circuit interrupters, timers, power taps, remotes, sensor receivers, radios, lights or even the plugs of all kind of electric facilities. The goal of designing these facilities this way is to have them connected, organized and incorporate their functions.

SUMMARY OF THE INVENTION

The present invention pertains to a holding unit for holding electrical devices, and a mounting system utilizing such holding units. The holding unit has an elongated body with first and second spaced apart, parallel walls, a central wall having opposite sides and extending between, and interconnecting the first and second spaced apart walls so as to form a generally C-shaped cross-sectional configuration with a mounting space between the first and second walls, which are resiliently movable. The holding unit also includes at least one recess formed in each of the opposite sides of the central wall such that each recess extends along a length of the elongated body and are configured to accept electrical wires therein. At least one mounting projection extends from each of the first and second walls into the mounting space and are configured to grip an electrical device such that the electrical device is releasably held in the mounting unit.

One or more fasteners may be utilized to attach the holding unit to a generally vertical wall surface such that one or more electrical devices may be attached to the holding unit and the associated electrical wires can be retained in the recesses so as to be hidden within the holding unit.

The holding unit according to the present invention enables a plurality of electrical devices to be connected together and for the resulting interconnecting wires to be visually hidden, thereby improving the aesthetics of the prior art mounting devices.

Further objects and advantages of the invention will be brought out in the following specification, wherein the detailed description is for the purpose of fully disclosing the preferred embodiments of the invention without placing limitations thereon.

BRIEF DESCRIPTION OF THE DRAWINGS

The invention will be more fully understood by reference to the following drawings which are illustrative purposes only.

DETAILED DESCRIPTION OF THE PREFERRED EMBODIMENTS

Figure 1:
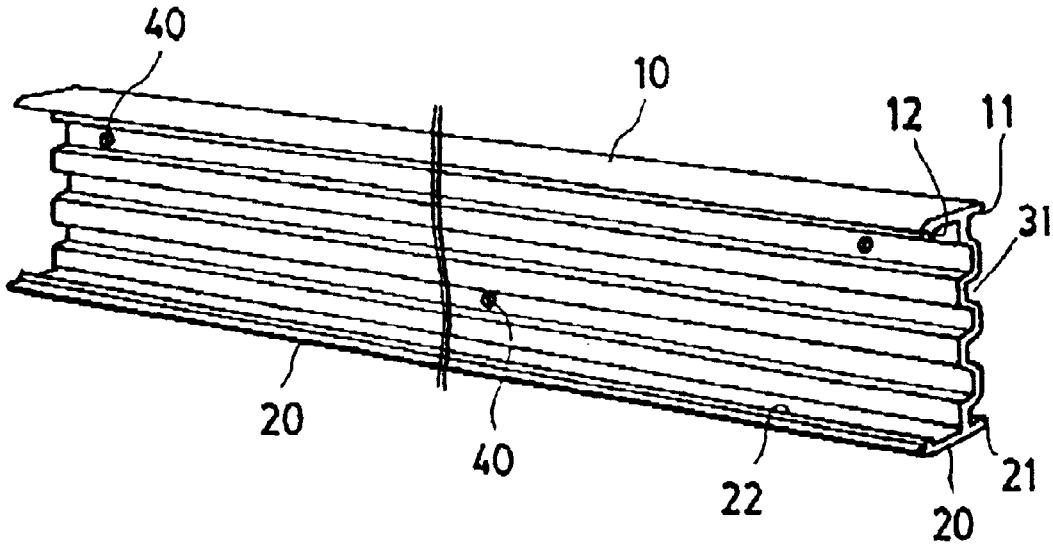
FIG. 1 is a perspective view of the holding unit of the present invention.
Figure 2:
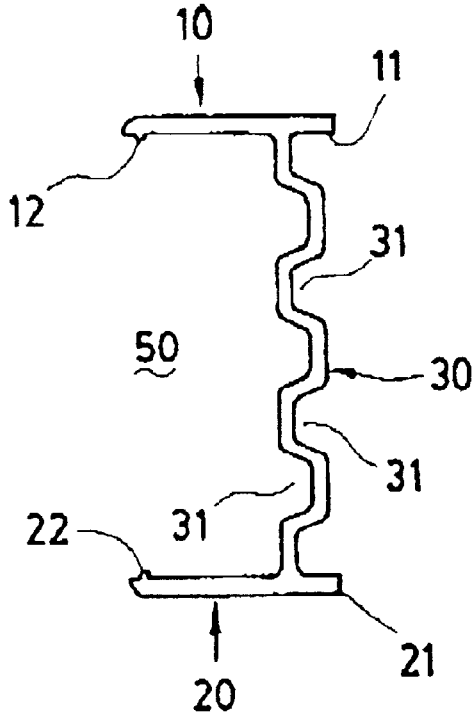
FIG. 2 is a side view of the holding unit of FIG. 1.

As best seen in FIGS. 1 and 2, the holding unit of the present invention has an elongated body formed by an upper wall 10, a bottom wall 20 and a central wall 30 extending between, and interconnecting the upper and lower walls 10, 20 so as to form a generally C-shaped cross-sectional configuration. The C-shape bounds a mounting space 50 between the upper and lower walls 10, 20 and the central wall 30. The elongated body is made of plastic, or thin metal such that the upper and lower walls 10, 20 are resiliently movable so as to facilitate the insertion of an electrical device therebetween.

Figure 3:
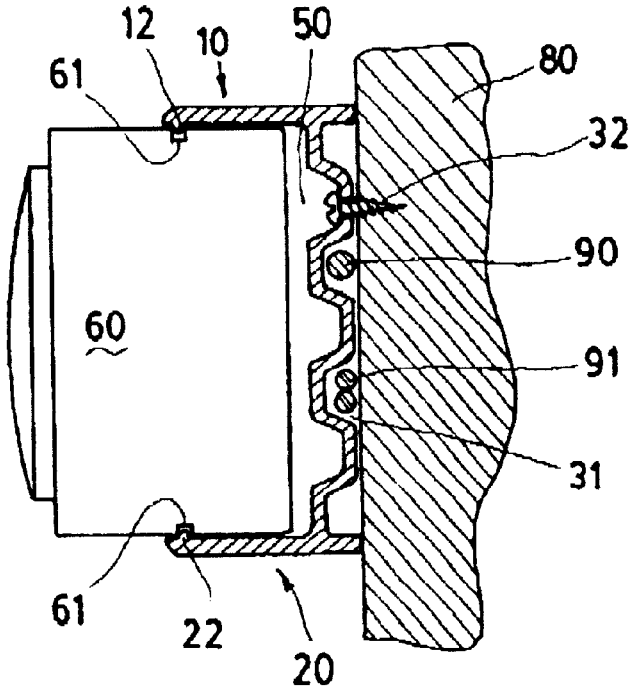
FIG. 3 is a cross-sectional view of the holding unit of the invention in use.

At least one recess 31 is formed in each of the opposite sides of the central wall 30 as illustrated in FIGS. 1–3. Each recess 31 extends along the length of the elongated body and is configured to receive electrical wires 90, 91 therein.

Upper wall 10 and lower wall 20 each have a distal end with at least one mounting projection, 12, 22 extending therefrom into the mounting space 50 and configured to grip an electrical device therebetween. Opposite ends 11, 21 of upper wall 10 and lower wall 20 extend beyond the central wall 30 such that opposite ends of each of the walls 10, 20 are located on opposite sides of the central wall 30.

As best seen in FIG. 3, the holding unit is attached to a vertical surface of wall 80 by one or more threaded fasteners 32 through holes 40 formed with, or drilled through, the elongated body. The holding unit serves to visually conceal the electrical wires 90, 91 when mounted to the wall surface to present a pleasing aesthetic effect and to organize the electrical wiring connections.

Figure 5:
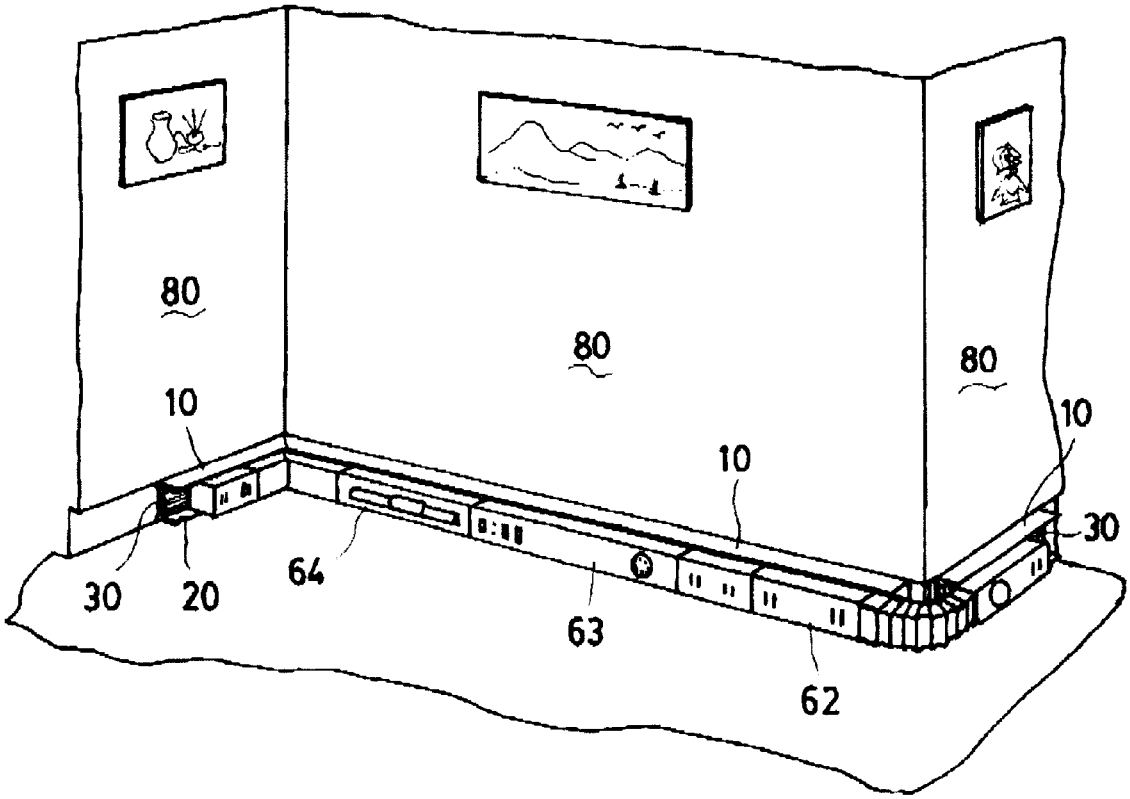
FIG. 5 is a perspective view of the holding unit of the present invention in use.

At least one electrical device 60 has indentations 61 therein which are configured to receive the mounting projections 12, 22 when the electrical device is inserted between the upper and lower walls 10, 20. Since the upper and lower walls 10, 20 are resiliently movable, the insertion of the electrical device 60 serves to resiliently displace the upper and lower walls until the mounting projections 12, 22 engage the corresponding indentations 61 of the electrical device 60. The resilient characteristics of the upper and lower walls 10, 20 serve to urge the mounting projections into engagement with the indentations 61 so as to releasably attach the electrical device 60 to the holding unit. As best seen in FIG. 5, a plurality of electrical devices 62, 63, 64 may be attached to the holding unit and the wires interconnecting the devices may be located within the recesses to provide an organized and a visually appealing appearance. The plurality of electrical devices may include, but is not limited to, surge protectors, ground fault circuit interrupters, timers, power taps, remotes, sensor receivers, radios, lights or plugs of all kind of electrical facilities. As is well known in the art, these devices may be electrically interconnected as desired by the user.

Figure 4:
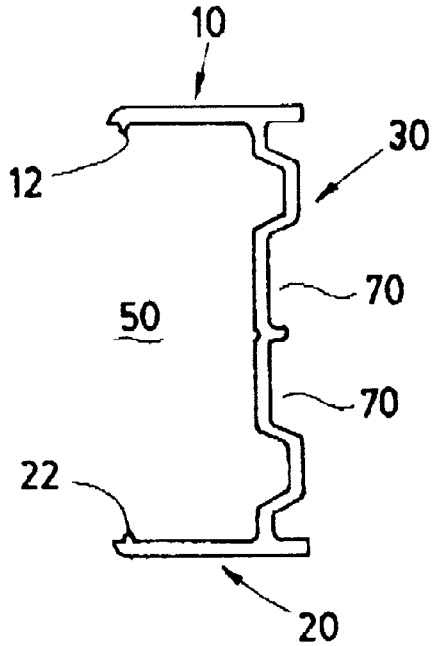
FIG. 4 is a side view of another embodiment of the holding unit of the present invention.

Recesses 31 are provided in both opposite sides of the central wall 30 and may comprise a plurality of such recesses on each side, as illustrated in FIG. 2. FIG. 4 illustrates another embodiment in which two of the recesses 70 are located in the same side of the central wall and are adjacent to each other, rather than being spaced apart as in the embodiment illustrated in FIG. 2. Other than the locations of the recesses, the embodiment of FIG. 4 is identical to the previously described embodiment. The spaced apart, alternating recesses 31 illustrated in FIG. 2 provides the central wall 30 with a serpentine cross-sectional configuration.

While particular elements, embodiments and applications of the present invention have been shown and described, it will be understood that the invention is not limited thereto, since modifications may be made by those skilled in the art, particularly in light of the foregoing teachings. It is therefore contemplated that the appended claims cover such modifications and incorporate those features which come within the spirit and scope of the invention.

What is claimed is:

1. A mounting system for mounting an electrical device to a wall surface comprising:

a) a holding unit comprising:

i) an elongated body having first and second spaced apart, parallel walls, a central wall having opposite sides and extending between and interconnecting the first and second spaced apart walls so as to form a generally C-shaped cross-sectional configuration with a single, elongated mounting space bounded by the first and second walls, the first and second walls being resiliently movable;

ii) at least one recess formed in each of the opposite sides of the central wall, each recess extending along a length of the body and configured to accept electrical wires therein; and, iii) at least one mounting projection extending from each of the first and second walls into the single, elongated mounting space and configured to grip an electrical device therebetween, wherein the first and second walls each have opposite ends located on opposite sides of the central wall;

b) at least one fastener attaching the holding unit to the wall surface;

c) at least one electrical device having indentations configured to accept the mounting projections therein, the at last one electrical device being inserted into the mounting space such that engagement of the mounting projections and the indentations releasably holds the at least one electrical device in the holding unit.

2. The mounting system of claim 1 wherein the holding unit further comprises a plurality of recesses on each side of the central wall.

3. The mounting system of claim 2 wherein two of the plurality of recesses on one side of the central wall are adjacent to each other.

4. The mounting system of claim 1 wherein the central wall of the holding unit has a serpentine cross-sectional configuration.

5. The mounting system of claim 1 further comprising a plurality of electrical devices, mounted in the holding unit.

6. The mounting system of claim 1 wherein the at least one electrical device is selected from a group of electrical devices consisting of surge protectors, ground fault circuit interrupters, timers, sensor receivers, power tap, radio and lights.

* * * * *